US007882859B2

(12) United States Patent
Hansen

(10) Patent No.: US 7,882,859 B2
(45) Date of Patent: Feb. 8, 2011

(54) SYSTEM FOR PREPARING AND MAKING AVAILABLE A FLOWABLE MEDIUM FORMED BY MIXING A DRY SUBSTANCE WITH A FLUID

(76) Inventor: Bernd Hansen, Talstr. 22-30, 74429 Sulzbach-Laufen (DE)

( * ) Notice: Subject to any disclaimer, the term of this patent is extended or adjusted under 35 U.S.C. 154(b) by 0 days.

(21) Appl. No.: 12/223,120

(22) PCT Filed: Dec. 21, 2006

(86) PCT No.: PCT/EP2006/012361

§ 371 (c)(1),
(2), (4) Date: Jul. 23, 2008

(87) PCT Pub. No.: WO2007/098801

PCT Pub. Date: Sep. 7, 2007

(65) Prior Publication Data

US 2009/0025823 A1 Jan. 29, 2009

(30) Foreign Application Priority Data

Mar. 2, 2006 (DE) ..... 10 2006 009 611

(51) Int. Cl.
*B65B 1/04* (2006.01)

(52) U.S. Cl. ..... 141/24; 141/2; 141/329

(58) Field of Classification Search ..... 141/2, 141/18, 21–24, 114, 329
See application file for complete search history.

(56) References Cited

U.S. PATENT DOCUMENTS

| | | | | |
|---|---|---|---|---|
| 2,724,383 | A | 11/1955 | Lockhart | |
| 4,203,443 | A | 5/1980 | Genese | |
| 5,609,580 | A | 3/1997 | Kwiatkowski et al. | |
| 5,957,166 | A * | 9/1999 | Safabash | 141/26 |
| 6,070,623 | A * | 6/2000 | Aneas | 141/329 |
| 6,637,470 | B2 * | 10/2003 | Reihl et al. | 141/27 |
| 2001/0025672 | A1 | 10/2001 | Thibault et al. | |

FOREIGN PATENT DOCUMENTS

| | | | |
|---|---|---|---|
| DE | 31 52 033 | A1 | 7/1983 |
| DE | 199 38 078 | A1 | 2/2001 |
| EP | 0 373 016 | A1 | 6/1990 |
| EP | 0 702 968 | A1 | 3/1996 |
| WO | WO 03/086268 | A1 | 10/2003 |
| WO | WO 2005/105014 | A2 | 11/2005 |

* cited by examiner

*Primary Examiner*—Timothy L Maust
*Assistant Examiner*—Jason K Niesz
(74) *Attorney, Agent, or Firm*—Roylance, Abrams, Berdo & Goodman, LLP

(57) ABSTRACT

A system for preparing and making available a flowable medium (43) that is formed by mixing a dry substance (39) with a fluid (41), in particular a medium for therapeutic purposes includes a) a first container (1) receiving the fluid (41) and has a wall part (3) able to deform counter to a restoring force to change the container volume, b) a second container (35) receiving the dry substance (39), and c) a transfer device (21) for producing a fluid communication between the first container (1) and the second container (35).

11 Claims, 3 Drawing Sheets

SYSTEM FOR PREPARING AND MAKING AVAILABLE A FLOWABLE MEDIUM FORMED BY MIXING A DRY SUBSTANCE WITH A FLUID

FIELD OF THE INVENTION

The present invention relates to a system for preparing and making available a flowable medium formed by mixing a dry substance with a fluid, in particular a medium for therapeutic purposes.

BACKGROUND OF THE INVENTION

Fluid media intended, for example, for therapeutic purposes or other purposes must often be freshly prepared close to the time they are actually to be used, because only the components forming the medium are inherently stable and/or storable enough. The ultimately prepared medium may not be inherently stable or storable enough. In practical applications, it is often necessary to store a dry substance and a fluid separately from one another until the use of the medium formed from a mixture of the dry substance and the fluid is imminent.

Generally the procedure followed involves taking the fluid, for example, a solvent, by a hypodermic needle and injecting it into a container containing the dry substance. Afterwards the resulting solution is removed with a new syringe to be applied or administered in the desired manner. In therapeutic applications, this administration can take place, for example, by injection, placement as an additive in an infusion container or the like.

Such application processes, in which injection needles are used, entail the risk that injuries can occur. This circumstance is extremely problematical when working in an environment in which the presence of HIV viruses can be expected.

SUMMARY OF THE INVENTION

An object of the present invention is to provide a system for preparing and making available a flowable medium formed by mixing a dry substance with a fluid, where the system has improved handling safety.

This object is basically achieved by a system, according to the present invention, including a transfer device as the additional system component. The fluid exchange between the containers involved necessary for preparing and making available the medium takes place in a closed operating process, i.e., without separate handling of the individual containers themselves and drawing up a syringe from one container and injection of the withdrawn fluid into the other container having been necessary. Because the first container holding the fluid has a wall part which can be deformed against a restoring force, the fluid from the first container can be forced by the transfer device into the second container holding the dry substance. In the latter container, the dry substance is then mixed with the fluid. When this mixing has taken place, the deformable wall part of the first container is released. As a result of the restoring force acting on the first container, its volume increases again and thus the prepared medium is intaken via the transfer device into the first container in which now the completely prepared medium is ready for use. The system according to the present invention enables safe handling without the risk of injury, and as a result of the closed operating process offers special protection against contamination.

Preferably, the wall part which can be deformed against the restoring force is formed by a bellows having an inherent restoring force against deformation. This container is preferably an ampule-like plastic container produced using the known Bottelpack® molding process and filled with the pertinent fluid. The container wall is provided with folds and is designed bellows-like such that it can be compressed in the axial direction to express the enclosed fluid. Such bellows formed from a suitable plastic material, after the compressive force acting on it is removed, returns to its original shape in which the volume of the container is returned to its original size.

Preferably, the first container for its connection to the transfer device on one end of the bellows can have a head part molded onto the bellows in one piece. On the head part, a catch is provided for engaging the catch present on a connecting means of the transfer device.

Preferably, a central, projecting connection piece has an end normally closed by a removable closure part, preferably a twist-off toggle integral with the connection piece.

The catch of the head part can be formed by arms integral with the head part and extending along the outside of the connection piece with the formation of an intermediate space. On the free end regions of the arms, catch bodies are molded which project in the direction to the connection piece and on which there are recessed catch notches.

In such configuration of the head part and of the catch means of the first container, the connecting means of the transfer device assigned to this container can have a hollow connecting shank. In order to form a plug connection with the connection piece of the first container, the connecting shank has an end-side widening as a seat for holding the connection piece extending with its outside wall surface into the intermediate space between the arms forming the catch of the head. In an especially simple manner, when the plug connection is formed by the holder of the connection piece of the first container in the seat of the hollow connecting shank of the transfer device, a fluid-tight connection is formed with simultaneous mechanical connection by the interacting catch means.

As catch means provided on the connecting means of the transfer device, catch projections can be molded onto the outer wall surface of the connecting shank and can interact with the catch notches on the arms of the head part to ensure that the plug connection has been formed in this way.

In advantageous embodiments, the transfer device in an extension of the connecting shank has a through channel. A channel end section is a component of the connecting means of the transfer device intended for the second container. The channel end section is formed by a projecting cannula. At the same time a fluid connection can be produced with the second container containing the dry substance, the second container closure can be penetrated by the cannula. Containers such as these, preferably in the form of small-volume glass bottles, are standard.

In especially advantageous embodiments, an additional system component can be a device which facilitates and simplifies joining the transfer device and the second container in the positional relationship provided for penetration of the closure by the cannula. For this purpose, a sleeve body is open on one end and on the other end has an end plate with a central through opening for the cannula of the transfer device. The sleeve body is designed such that it forms a guide for the second container which can be inserted into the sleeve body from the open end in the direction to the cannula. To implement the connection process, the second container, for example, in the form of a small-volume glass bottle of the conventional type, need simply be pushed into the sleeve body after the transfer device has been inserted beforehand into the sleeve body through the central through opening of the end plate. This arrangement ensures that when the container is pushed into the sleeve body the cannula penetrates the central region, i.e., the region of the closure of the second container which can be penetrated.

In this configuration of the sleeve body, at the same time it forms a protective jacket of the inserted cannula. Although this cannula, in contrast to conventional injection needles, does not pose a significant injury risk, an additional improvement of handling safety is achieved by the jacketing.

The present invention is also a container intended for use in the system according to the present invention.

This invention also relates to the use of a system and a container for preparing and making available a flowable medium.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
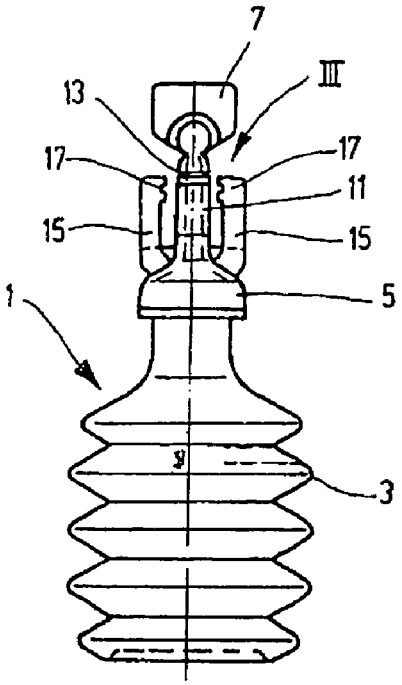
FIG. 1 is a front elevational view of a bellows ampule intended as the first container of the system, shown approximately in natural size, according to an exemplary embodiment of the present invention.
Figure 2:
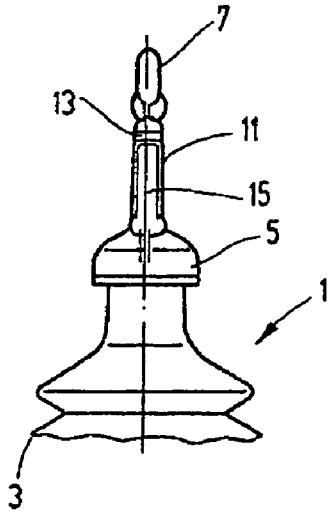
FIG. 2 is a partial side elevational view of only the region of the ampule from FIG. 1 adjacent to its head part, turned 90° around the longitudinal axis of the ampule.

FIG. 1 shows a bellows ampule 1 in a closed state forming a component of the system according to the present invention and described here as the first container. The ampule 1 includes bellows 3 forming its actual receiving space, a head part 5 adjoining bellows 3 as a closure part, and a twist-off toggle 7 closing its outlet opening 9 (FIG. 3), is produced using the known Bottelpack® process from plastic in one piece, and is filled with a fluid. The plastic material used for production has a certain elastic property so that when the twist-off toggle 7 is removed, the bellows 3, forming a deformable wall part of the container, can be compressed in the axial direction so that by a respective reduction of the volume the contained fluid can be expressed from the opening 9 (FIG. 3) on the connection piece or hollow central projection 11. If the bellows 3 is released, due to the restoring force dictated by its elasticity it returns to the original shape shown in FIG. 1, with the interior of the bellows 3 again having the initial volume.

Figure 3:
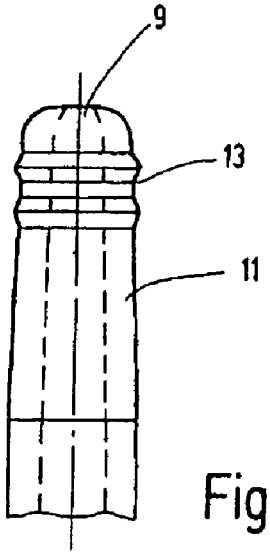
FIG. 3 is a partial front elevational view solely of the region of the connecting piece provided with a Luer connection on the head part of the bellows ampule, which region is identified with arrow III in FIG. 1, and which view is shown detached and greatly enlarged relative to FIGS. 1 and 2.
Figures 4, 5, 7A, 7B, 7C:
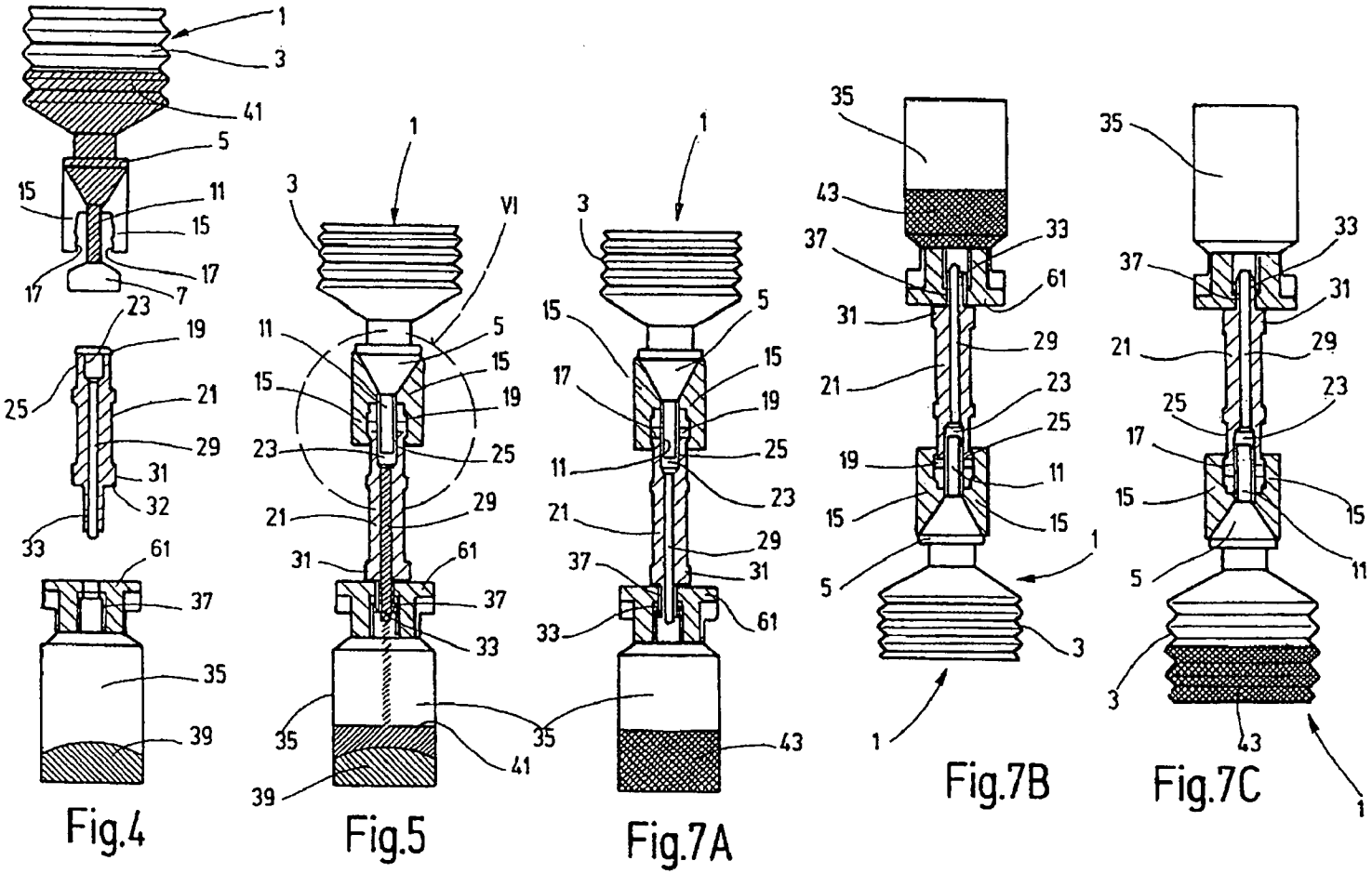
FIG. 4 is an exploded side elevational view, partially in section, of one embodiment of the system according to the present invention including the bellows ampule of FIG. 1 as a first container, a transfer device and a glass bottle as the second container.
FIG. 5 is a side elevational view, partially in section, of the system of FIG. 4 in the assembled position and in a state corresponding to a first working step of the operating sequence.
FIGS. 7A, 7B and 7C are side elevational views partially in section of the system which are similar to FIG. 5 in the operating states corresponding to second, third and fourth steps of the operating sequence, respectively.
Figure 6:
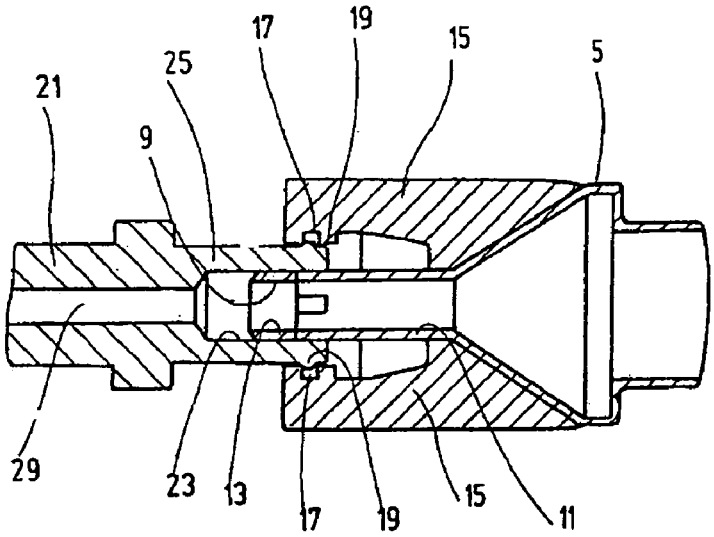
FIG. 6 is a partial elevational view in section of the region designated as VI in FIG. 5, greatly enlarged compared to FIG. 5.

FIG. 3 shows the outside shape of the connection piece 11 of the head part 5. On the end region having the opening 9, there is a Luer connection 13. Arms 15 with catch bodies are molded onto the head part 5 on both sides of the connection piece 11 and extend in the axial direction at a distance from the outside of the connection piece 11. In the vicinity of the end edges of these arms 14, there are recessed catch notches 17 intended for locking with a catch rib 19 located on a transfer device 21 used as another component of the system. Locking occurs when, proceeding from the operating state shown in FIG. 4, the twist-off toggle 7 of the bellows ampule 1 is removed and as the next step of the operating sequence a plug connection to the transfer device 21 is established, as is shown in FIG. 5. Details of the plug connection produced with the transfer device 21 are illustrated in FIG. 6 on a larger scale showing the region VI in FIG. 5. The connection piece 11 is located on the head part 5 within a widened seat 23 in a hollow connection shank 25 of the transfer device 21, and is suitably held in the seat 23, i.e., sealed. As most clearly shown in FIG. 6, the catch rib 19 is located on the outside of the shank 25 in the vicinity of its free end. The arms 15 having the catch notches 17 extend from the head part 5 over the outside of the shank 25 to above the catch rib 19 which snaps into the notches 17.

FIGS. 5, 7A, 7B, and 7C illustrate the continuing operating sequence in the use of the system according to the present invention. As is apparent, the transfer device 21 in an extension of the seat 23 of the connecting shank 25 has an axial through channel 29 extending through a thickened region 31 forming a stop shoulder 32 (FIG. 4), and ends in an axially projecting cannula 33. A glass bottle 35 acting as the second container of the system has a closure 37 which can be penetrated by a cannula 33, and can be placed on the stop shoulder 32 so that the end of the cannula 33 extends into the interior of the bottle 35. When this is the case, and when a plug connection has been established between the bellows ampule 1 and the transfer device 21, by compressing the bellows 3 the fluid in the ampule 1 is expressed and forced into the bottle 35 via the transfer device 21. For preparing the medium to be produced, in the initial state shown in FIG. 4 the bottle contains, for example, a dry substance 39 to which the fluid, for example, a solvent 41, see FIG. 5, is added.

FIG. 7A shows as the next step the operating state in which after mixing the dry substance 35 with the solvent 41 the prepared medium 43 is in the bottle 35. To return the prepared medium from the bottle 35 via the transfer device 21 to the bellows ampule 1 so that the prepared medium is made available in it, as is shown in FIG. 7B, the system is turned around, whereupon, as is shown in FIG. 7C, the compressed bellows 3 is now released so that due to the increase of its volume the medium 43 is sucked back out of the bottle 35 into the bellows ampule 1, see FIG. 7C. After releasing the plug connection with the transfer device 21 the prepared medium is now made available in the ampule 1.

Figure 8:
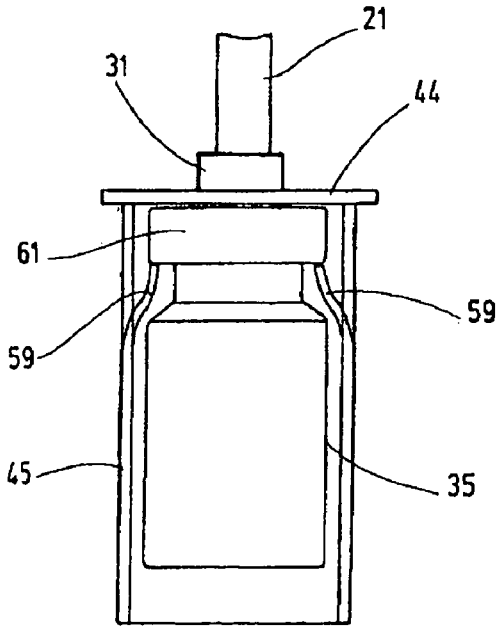
FIG. 8 is a side elevational view slightly enlarged relative to a practical embodiment, in which the second container, a sleeve body used as a connecting device, and only the end section of the transfer device adjacent to the second container are shown.
Figure 9:
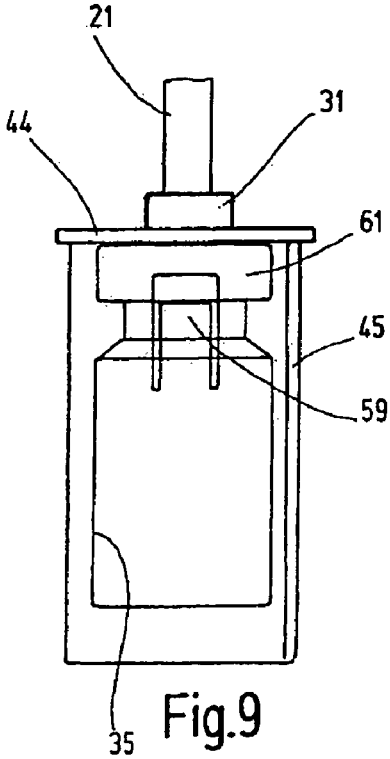
FIG. 9 is a front elevational view corresponding to FIG. 8 and turned 90° relative thereto.

FIGS. 8 and 9 show a version of the system with a connection device to bring the bottle 35 forming the second container easily and comfortably into defined alignment with the transfer device 21. One particular feature of the device is that at the same time it forms a protective jacket for the cannula 33 of the transfer device 35, as is apparent from FIGS. 8 and 9. These figures show that the bottle 35 with the cannula inserted is surrounded by the sleeve body 45 in the form of a hollow cylinder which is open on the end facing away from the transfer device 21, so that the bottle can be pushed into the sleeve body 45 in the axial direction from the open end and can be moved into a position in which the cannula 33 enters the bottle 35. The sleeve body 45 on the end lying on the stop shoulder 32 of the transfer device 21 has an end plate 44 surrounding the central through opening for the cannula 33.

As FIGS. 8 and 9 moreover show, in the wall of the sleeve body 45 notches 59 are cut out extending elastically into the interior of the jacket 45. When the bottle 35 is pushed into the sleeve body 45, these wall parts on the bottle neck snap in behind the top part of the bottle 61. The bottle 35 which has been pushed into the sleeve body 45 is then secured in position. The sleeve body 45 is preferably molded from a transparent plastic material so that when the system is being used the process of mixing of the fluid 41 and the dry substance can be visually observed.

While one embodiment has been chosen to illustrate the invention, it will be understood by those skilled in the art that various changes and modifications can be made therein without departing from the scope of the invention as defined in the appended claims.

The invention claimed is:

1. A system for preparing and making available a flowable medium formed by mixing a dry substance with a fluid, comprising:

a first container holding the fluid, having a wall part deformable against a restoring force to change a volume of said first container and having a head part with a first catch on one end thereof, said head part having a hollow central projection with a free end and a Luer connection adjacent said free end, said first catch including arms with catch bodies integrally molded with said head part, extending along an outside surface of said central projection and forming an intermediate space therebetween, said catch bodies having free end regions with first catch parts thereon facing said central projection;

a second container holding the dry substance;

a transfer device connecting said first and second containers in fluid communication and having a connector with a second catch releasably engageable and mating with said first catch parts and having a seat sealable to said Luer connection; and a removable twist-off toggle closure part integral with said central projection normally closing said Luer connection of said central projection.

2. A system according to claim 1 wherein said wall part comprises a bellows having an inherent restoring force against deformation.

3. A system according to claim 1 wherein said transfer device comprises a hollow connection shank with an end-side widening forming said seat and with an outside wall surface extending into said intermediate space between said catch bodies of said arms.

4. A system according to claim 3 wherein said second catch comprises a catch rib on said outside wall surface of said transfer device engageable in said first catch parts.

5. A system according to claim 4 wherein said connection shank has a through channel in an extension thereof with an end section having a projecting cannula connectable with said second container.

6. A system according to claim 3 wherein said connection shank has a through channel in an extension thereof with an end section having a projecting cannula connectable with said second container.

7. A system according to claim 6 wherein said second container has a closure penetratable by said cannula.

8. A system according to claim 7 wherein a device joins said transfer device and said second container in proper positions thereof for penetration of said closure of said second container by said cannula.

9. A system according to claim 8 wherein said device comprises a sleeve body being open on one end and having a plate on another end, said plate having a central through opening for receiving said cannula and having a guide receiving said second container when inserted into said sleeve body from said one end toward said cannula.

10. A method for preparing and making available a flowable medium formed by mixing a dry substance with a fluid, comprising the steps of removing an integral twist-off toggle closure part normally closing a Luer connection adjacent a free end of a hollow central projection of a first container holding a fluid;

connecting the first container to a transfer device by releasably engaging first catch parts on free end regions of catch bodies of arms integrally molded on a head part of the first container to extend along an outside surface of the central projection of the first container to form an intermediate space between the central projection and the arms with a second catch on the transfer device and by releasably engaging and sealing the Luer connection with a seat in the transfer device;

connecting a second container holding a dry substance to the transfer device such that the first and second containers are in fluid communication;

compressing a wall part of the first container against a restoring force thereof to change a volume of the first container and to force the fluid in the first container through the transfer device and into the second container to mix with the dry substance to produce the flowable medium in the second container; and terminating compressing the wall part and allowing the restoring force to expand the volume of the first container to cause the flowable medium to be conveyed through the transfer device into the first container.

11. A container according to claim 1 wherein said first catch parts comprise laterally inwardly facing recessed notches; and said second catch comprises a radially outwardly extending catch rib on said transfer device receivable in said recessed notches.

* * * * *